US006062235A

United States Patent [19]

Renna

[11] Patent Number: 6,062,235

[45] Date of Patent: May 16, 2000

[54] COSMETIC SAMPLER

[75] Inventor: Douglas J. Renna, Valley Stream, N.Y.

[73] Assignee: Cosmetic Sampling Technologies, Inc., Hauppauge, N.Y.

[21] Appl. No.: 09/386,541

[22] Filed: Aug. 30, 1999

[51] Int. Cl.[7] ..... A45D 40/26; A45D 40/24; B65D 75/00

[52] U.S. Cl. ..... 132/320; 132/317; 206/823

[58] Field of Search ..... 132/320, 293, 132/317; 206/823, 209, 581; 283/56

[56] References Cited

U.S. PATENT DOCUMENTS

| | | | |
|---|---|---|---|
| 4,995,408 | 2/1991 | Wallschlaeger | 132/320 |
| 5,031,647 | 7/1991 | Seidler | 131/320 |
| 5,109,879 | 5/1992 | Seidler | 132/320 |
| 5,161,688 | 11/1992 | Muchin | 206/484 |
| 5,647,941 | 7/1997 | Gunderman et al. | 156/277 |
| 5,699,574 | 12/1997 | Oviatt | 15/210.1 |
| 5,904,151 | 5/1999 | Gueret | 132/293 |
| 5,918,608 | 7/1999 | Rennna | 132/320 |

*Primary Examiner*—John J. Wilson
*Assistant Examiner*—Robyn Kieu Doan
*Attorney, Agent, or Firm*—Collard & Roe, P.C.

[57] ABSTRACT

A cosmetic sampler comprising an elongated base formed from a sheet with a top portion and a bottom portion. The top portion has an applicator portion and a discard portion separable from the applicator portion. The discard portion has a first hinge therethrough at a midpoint thereof and perpendicular to the longitudinal axis of the base and a second hinge therethrough where the top portion connects to the bottom portion. There is a cosmetic product disposed on a part of the applicator portion and a transparent protective layer disposed over the top portion of the base. An adhesive attaches the protective layer to the base, covering the discard layer above the first hinge and only partially covering the discard layer between the first hinge and the second hinge, so that the protective layer is easily lifted off of the base below the first hinge. In use, the protective layer is lifted off of the base, causing the discard portion to separate from the applicator portion and bend at the hinges to reveal the cosmetic product for application. The discard portion can then be torn off of the sampler, taking the protective layer with it and leaving a stiff, elongated applicator with the cosmetic disposed thereon.

13 Claims, 2 Drawing Sheets

COSMETIC SAMPLER

BACKGROUND OF THE INVENTION

1. Field of the Invention

This invention relates to a cosmetic sampler containing a single application of cosmetic product. In particular, this invention relates to a cosmetic sampler formed from a single sheet of paperboard and covered with a plastic shield, that safely stores a single application of cosmetic product and which converts into a convenient applicator as well.

2. The Prior Art

Consumers of cosmetics usually like to sample a particular product prior to purchasing it, to test the color or fragrance on their skin. Many consumers do not like to use the full-size "tester" products provided in the stores, due to fear of contamination by other shoppers.

There have been many attempts to construct disposable cosmetic samplers that provide only a single-application of cosmetic product. Some of the more commonly seen ones are the tiny vials of perfume or perfume tester strips. Other tester strips often include cosmetic samples such as eye shadow or blusher whose consistency has been altered for packaging purposes.

Other samplers comprise a perforated paper strip with a dose unit of product deposited between each perforation and sealed with a transparent sealing strip. Such a sampler is shown in U.S. Pat. No. 4,884,719 to Levine et al.

Another type of sampler is shown in U.S. Pat. No. 4,824,113 to Grainger, which shows a series of folded panels with a dose of a cosmetic product deposited on one of the panels. A window on another panel overlies the product when the panels are folded up, so the consumer can see the color of the product. Another sampler is shown in U.S. Pat. No. 5,161,688 to Muchin. This sampler is made by punching a hole in a laminate having backing and covering layers, to create a reservoir for holding a portion of product. A film is applied on top of the hole to keep the product inside. Yet another sampler is disclosed in U.S. Pat. No. 4,747,782 to Campbell, Jr. which shows the product deposited on a folded sheet having a barrier.

The drawback of all of these samplers is that they do not provide a convenient way for the consumer to apply the cosmetic. Separate tools or fingers must be used to apply the cosmetic from these samplers to the user's face. A sampler with an integral applicator is shown in U.S. Pat. No. 5,690,130 to Gunderman et al. However, this applicator is a separate piece that is broken off of the package and used to apply the cosmetic.

Yet another sampler is shown in U.S. patent application Ser. No. 09/072,547 to Renna. This sampler is formed from a single sheet of paperboard that is scored in several placed and folded over itself. The cosmetic is applied to one end and a portion of the sampler is folded over the cosmetic. This portion has a window cut out and covered with plastic to allow the user to see the cosmetic. In use, the sampler is unfolded and the portion containing the cosmetic ends up at the end of the sampler and can be conveniently applied to the user's face directly from the sampler. While this sampler is a convenient way to display and test products, it would be desirable to provide a sampler that simulates the actual size and shape of a cosmetic applicator such as a lipstick, yet is simple and economical to produce.

SUMMARY OF THE INVENTION

It is therefore an object of the present invention to provide a cosmetic sampler that allows the consumer to easily apply the cosmetic directly to their face or body.

It is another object of the present invention to provide a cosmetic sampler that does not require the original cosmetic product to be altered for sampling.

It is another object of the present invention to provide a cosmetic sampler that supplies a single application of cosmetic in a hygienic and attractive package.

It is yet another object of the present invention to provide a cosmetic sampler that is small and easily stackable in large quantities.

It is a further object of the present invention to provide a cosmetic sampler that is simple and inexpensive to manufacture.

It is yet a further object of the invention to provide a cosmetic sampler that simulates the size and shape of the actual cosmetic or applicator.

These and other objects of the present invention are achieved by a cosmetic sampler comprising an elongated base formed from a sheet of stiff material with a top portion and a bottom portion. The top portion has an applicator portion and a discard portion separable from the applicator portion. The discard portion has a first hinge therethrough at a midpoint thereof and perpendicular to the longitudinal axis of the base and a second hinge therethrough where the top portion connects to the bottom portion. There is a cosmetic product disposed on a part of the applicator portion and a transparent protective layer disposed over the top portion of the base. The protective layer is raised in a dome shaped bubble over the cosmetic product so as not to touch it. An adhesive attaches the protective layer to the base, covering the discard layer above the first hinge and only partially covering the discard layer between the first hinge and the second hinge, so that the protective layer is easily lifted off of the base below the first hinge. The sampler is used as follows: The protective layer is lifted off of the base, causing the discard portion to separate from the applicator portion and bend at the hinges to reveal the cosmetic product for application. The discard portion can then be torn off of the sampler, taking the protective layer with it and leaving a stiff, elongated applicator with the cosmetic disposed thereon.

The sampler base is preferably made of stiff paperboard, but other materials could be used as well. The sampler could be manufactured in multiples on a single sheet of paperboard, with each sampler separated by a perforation. Adjacent samplers could be manufactured with different colors of the cosmetic product, creating a multiple sampler for a single consumer to try. The protective layer could also be applied as a single layer over the multiple bases, and separated by a perforation. This allows the manufacturer to make large quantities of the sampler at low cost and in a short amount of time. Another advantage of the paperboard is that it can be coated or decorated in many ways. It can be imprinted with the name of the cosmetic company, coated with foil, or have decorative designs applied to it.

In this embodiment, the discard portion and applicator portion are separated by a perforation in the base material. Pulling the protective layer off of the base causes the hinges to bend and the discard portion and applicator portion to separate at the perforation. The perforated area is preferably bullet shaped to resemble a lipstick. However, other shapes, such as square, semicircular or triangle could also be used. The hinges are preferably scores in the base material.

The protective layer preferably has a tab extending toward the bottom portion of the base and not adhered to the base. Pulling the tab upward lifts the protective layer off of the base to reveal the cosmetic product for sampling.

While the sampler according to the invention is ideally constructed to be a lipstick sampler, other products could be affixed to the sampler as well. For example, pressed powder, blusher, wax-based perfume, base makeup and eye shadow could also be used. The present invention allows these products to be sampled in their original state, so no alterations of the texture and color of the products occur. Additionally, it could also be envisioned that the sampler according to the invention could also be used to sample topical medications. The only requirement is that the product have a sufficiently solid consistency so as to maintain its shape and position on the applicator tip.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
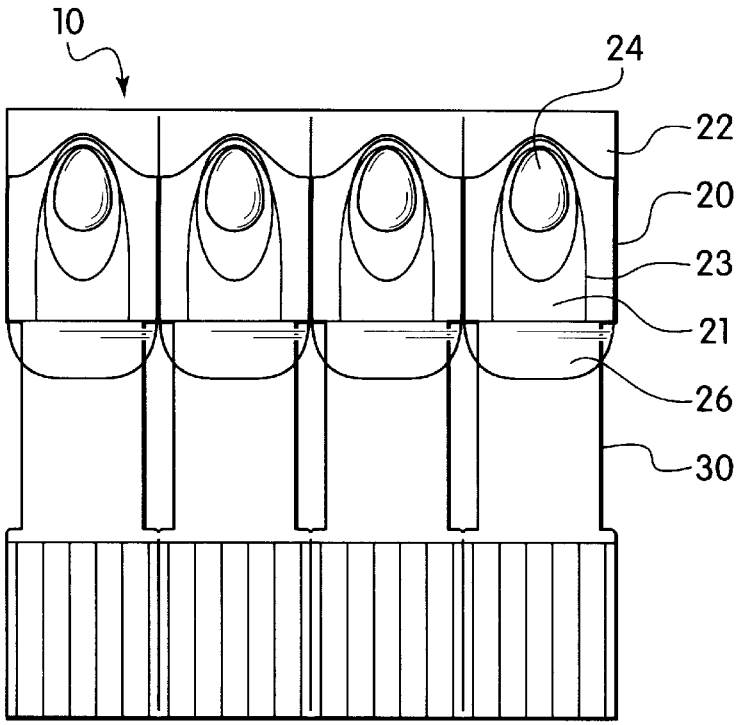
FIG. 1 shows a series of cosmetic samplers disposed on a single sheet.
Figure 2:
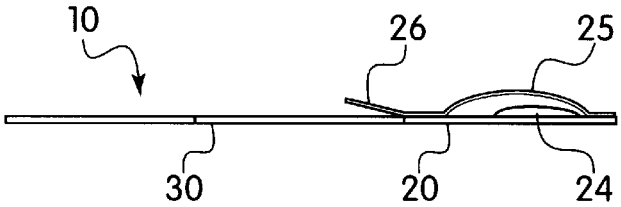
FIG. 2 shows a side view of the cosmetic sampler according to the invention.
Figure 3:
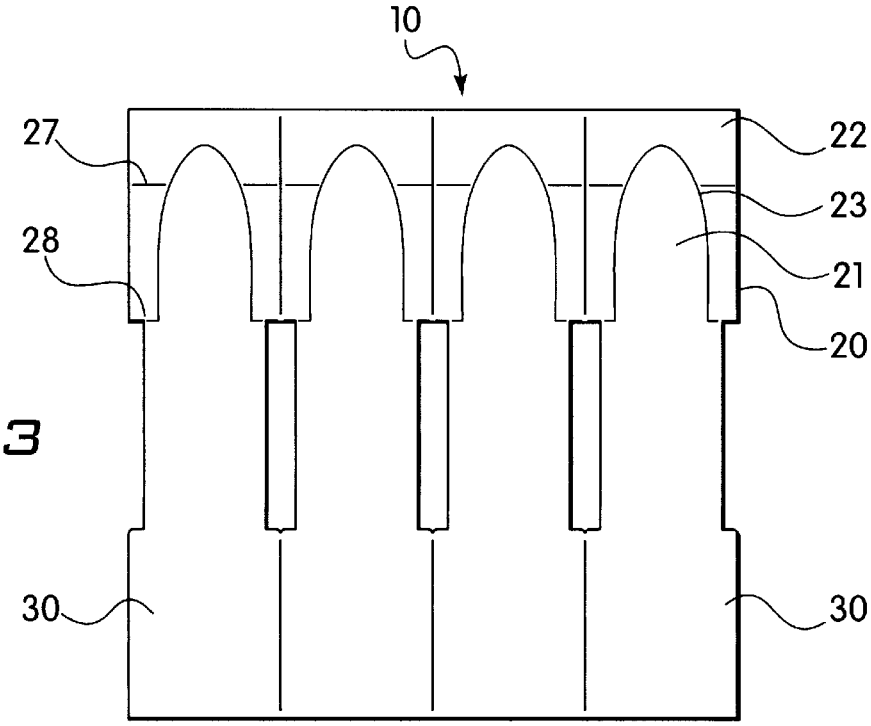
FIG. 3 shows a rear view of the series of cosmetic samplers shown in FIG. 1.

Referring now in detail to the drawings and, in particular, FIGS. 1–3, there is shown a sheet of cosmetic samplers 10 according to the invention. Samplers 10 are disposed on a single sheet of paperboard and separated by perforations 11. Sampler 10 is comprised of a top portion 20, and a bottom portion 30. Top portion 20 has an applicator portion 21 separated from a discard portion 22 by perforations 23. A cosmetic product 24 is disposed on the tip of the applicator portion 21. Cosmetic product 24 can be any type of solid based cosmetic, such as lipstick, pressed powder, eye shadow, solid perfume or other types of cosmetics.

A protective layer 25 is disposed on top of top portion 20 of sampler 10. Protective layer 25 is a clear plastic layer having a dome shaped bubble disposed over cosmetic product 24. Protective layer 25 protects cosmetic product 24 from dirt and smudging yet allows the consumer to see the product. Protective layer 25 has a tab 26 that allows the consumer to remove protective layer 25 from sampler 10 to access cosmetic product 24.

A rear view of sampler 10 is shown in FIG. 3. The discard portion 22 of sampler 10 has two hinges 27 and 28 formed therein to allow discard portion 22 to bend under pressure at hinges 27 and 28. Hinges 27 and 28 are formed by scoring sampler 10.

Figure 4:
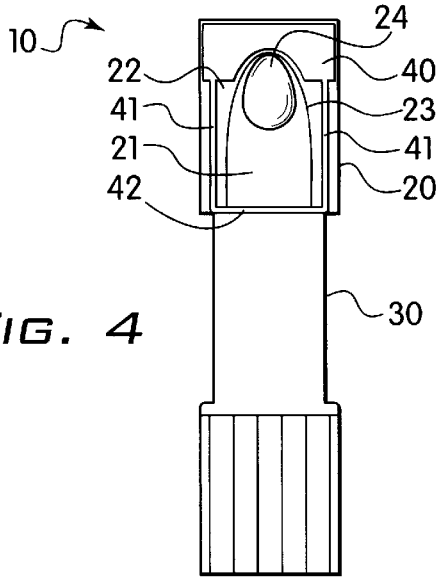
FIG. 4 shows a top view of the base material of the sampler according to the invention showing the pattern of adhesive application.

Protective layer 25 is adhered to sampler 10 by a layer of adhesive formed in the pattern shown in FIG. 4. A solid layer of adhesive 40 coats discard portion 22 above hinge 27 to adhere protective layer 25 solidly to this portion. Between hinges 27 and 28, a stripe of adhesive 41 is applied on both sides of discard portion 22. Another strip of adhesive 42 is applied across the bottom of discard portion 22 and applicator portion 21. This adhesive pattern keeps protective layer 25 firmly covering cosmetic 24, yet allows protective layer 25 to be easily lifted off of sampler 10 up to hinge 27.

Figure 5:
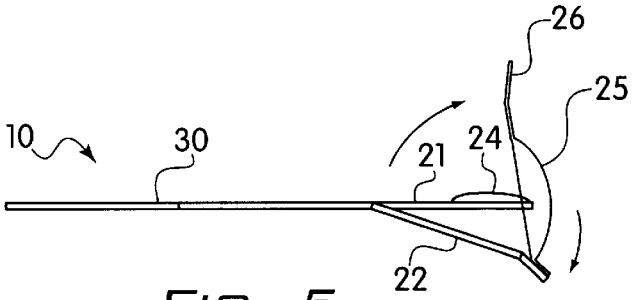
FIG. 5 shows a side view of the sampler with the discard portion partially folded.
Figure 6:
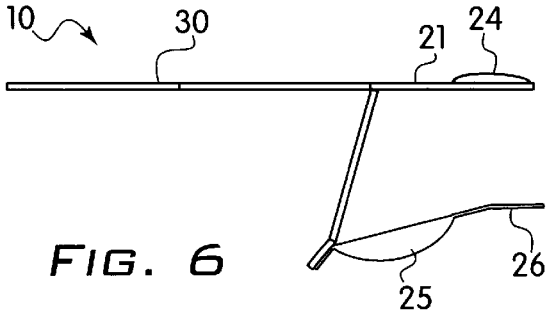
FIG. 6 shows a side view the sampler with the discard portion folded completely back.
Figure 7:
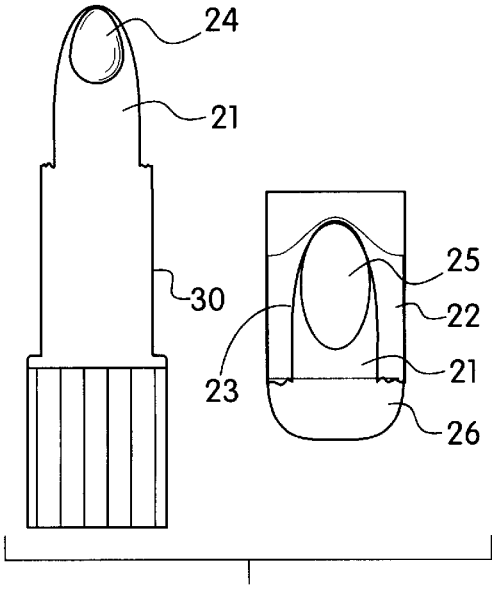
FIG. 7 shows a front view of the sampler and discard portion after the discard portion is removed.

The opening up of sampler 10 for use is shown in FIGS. 5–7. As tab 26 is lifted off of sampler 10, hinges 27 and 28 bend and allow discard portion 22 to separate from applicator portion 21. Discard portion 22 is bent entirely back through the flexing motion of hinges 27 and 28 and allows applicator portion 21 to be accessible to the user. Upon full separation of discard portion 22 from application portion 21, discard portion 22 can be torn off from sampler 10 along the score of hinge 28 to make sampler 10 a convenient cosmetic applicator, as shown in FIG. 7. The action of hinges 27 and 28 are such that the lifting of protective layer 25 is accomplished without touching or interfering in any way with applicator portion 21 or cosmetic product 24 disposed thereon. Discard portion 22 with protective layer 25 bends back easily and frees applicator portion 21 for use by the consumer.

Accordingly, while only one embodiment of the present invention have been shown and described, it is obvious that many changes and modifications may be made thereunto without departing from the spirit and scope of the invention.

What is claimed is:

1. A cosmetic sampler comprising:

an elongated base formed from a sheet of stiff material, said base having a top portion, a bottom portion connected to the top portion and a longitudinal axis, said top portion having an applicator portion and a discard portion separable from said applicator portion, said discard portion having a first hinge therethrough at a midpoint thereof and perpendicular to the longitudinal axis of the base and a second hinge therethrough where the top portion connects to the bottom portion;

a cosmetic product disposed on said applicator portion; and a transparent protective layer disposed over said top portion of said base, said protective layer being raised over said cosmetic product so as not to touch said cosmetic product; and an adhesive attaching said protective layer to said base, said adhesive covering said discard layer above said first hinge and only partially covering said discard layer between the first hinge and the second hinge, so that the protective layer is easily lifted off of the base below the first hinge, wherein lifting the protective layer off of the base causes the discard portion to separate from the applicator portion and bend at the hinges to reveal the cosmetic product for application.

2. The cosmetic sampler according to claim 1, wherein the base is made of paperboard.

3. The cosmetic sampler according to claim 1, wherein the discard portion and applicator portion are separated by a score in the base material.

4. The cosmetic sampler according to claim 1, wherein the hinges are scores in the base material.

5. The cosmetic sampler according to claim 1, wherein the protective layer is made of plastic and wherein the protective layer has a dome-shaped portion disposed over the cosmetic product.

6. The cosmetic sampler according to claim 1, wherein the protective layer has a tab extending toward the bottom portion of the base, said tab being not adhered to the base and wherein pulling the tab lifts the protective layer off of the base.

7. The cosmetic sampler according to claim 2, wherein the paperboard is coated with a foil.

8. The cosmetic sampler according to claim 2, wherein the base is connected to other bases on a single sheet and separated by the other bases by a score.

9. The cosmetic sampler according to claim 1, wherein the cosmetic product is lipstick.

10. The cosmetic sampler according to claim 1, wherein the cosmetic product is eye shadow.

11. The cosmetic sampler according to claim 1, wherein the cosmetic product is pressed powder.

12. The cosmetic sampler according to claim 3, wherein the score is substantially U-shaped.

13. The cosmetic sampler according to claim 1, wherein the adhesive is further disposed in a line perpendicular to the longitudinal axis above the second hinge.

* * * * *